United States Patent [19]

McDougal

[11] Patent Number: 4,704,943

[45] Date of Patent: Nov. 10, 1987

[54] IMPACT STRUCTURES

[76] Inventor: John A. McDougal, 14388 Harbor Island, Detroit, Mich. 48215

[21] Appl. No.: 695,411

[22] Filed: Jan. 25, 1985

Related U.S. Application Data

[63] Continuation of Ser. No. 273,965, Jun. 15, 1981, abandoned.

[51] Int. Cl.[4] ..... F41H 5/02

[52] U.S. Cl. ..... 89/36.02; 109/80; 428/911

[58] Field of Search ..... 89/36.02; 114/12; 109/80, 82, 84, 85; 428/911, 141, 142

[56] References Cited

U.S. PATENT DOCUMENTS

| | | | |
|---|---|---|---|
| 1,748,080 | 2/1930 | Reece | 428/141 |
| 1,844,512 | 2/1932 | Mains | 109/84 |
| 2,959,507 | 11/1960 | Long | 428/142 |
| 3,395,067 | 7/1968 | Lane | 89/36 A |
| 3,509,833 | 5/1970 | Cook | 109/82 |
| 3,592,147 | 7/1971 | Harper | 89/36 A |
| 3,705,558 | 12/1972 | McDougal et al. | 109/84 |
| 3,807,970 | 4/1974 | Greene | 109/84 |
| 4,173,932 | 11/1979 | Matte et al. | 89/36 A |
| 4,300,439 | 11/1981 | Degnan et al. | 89/36 A |

OTHER PUBLICATIONS

"New G-E Ceramic Transmits Light, Possesses Great Strength, Resists Extremely High Temps", Ceramic Industry, Oct. 1959, pp. 57, 119.

Good et al., Ammunition, 1982, pp. 116-118.

"Fractography of Ballistically Tested Ceramics", V. D. Frechette and C. F. Cline, Ceramic Bulletin, vol. 49, No. 11 (1970).

"Shockwaves in Solids", Ronald K. Linde and Richard C. Crewdson, May 1969, Scientific American Magazine.

"Omnidirectional Scattering of Acoustic Waves from Rough Surfaces of Known Statistics", R. K. Moore and B. E. Parkins, the Journal of the Acoustical Society of America, vol. 40, No. 1, 1966.

*Primary Examiner*—Stephen C. Bentley

*Attorney, Agent, or Firm*—Harness, Dickey & Pierce

[57] ABSTRACT

Structures both for resisting impacts as well as delivering impacts are described. Generally, the impact resisting structures are formed with means for preventing the reinforcing intersection of a sonic wave train with its own reflection within the structure, such that at least one shock wave fracture mode is eliminated. More specifically, the structures are formed with means for suppressing the specular reflection of high frequency energy at one or more surfaces of the structure. This means may comprise irregularities formed in a surface to roughen the surface in a predetermined relationship with the wavelength of the sonic energy. The impact delivery structures are adapted to rapidly deliver kinetic energy after an initial contact with an object. These structures may comprise a projectiles having a jacket and a spline supported therein for providing a high velocity channel through which a sonic energy wave train may propagate.

7 Claims, 19 Drawing Figures

FIG. 6.
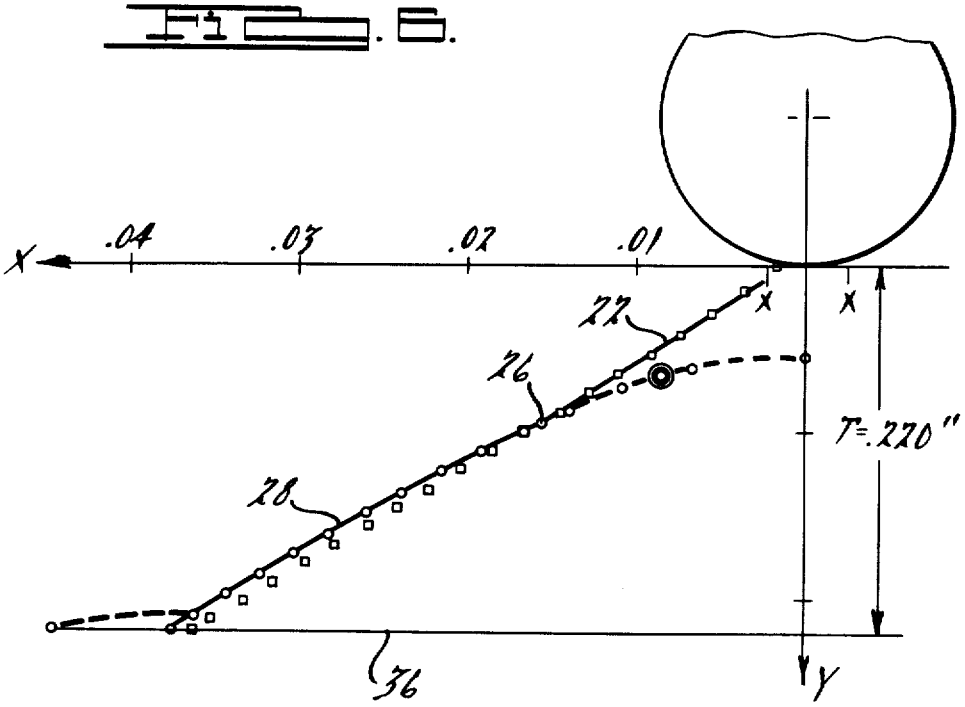
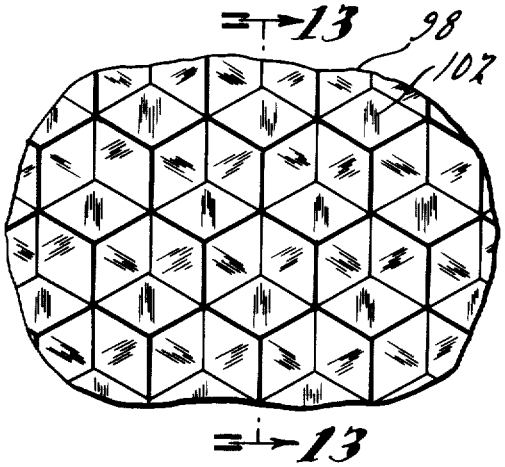
FIG. 12.
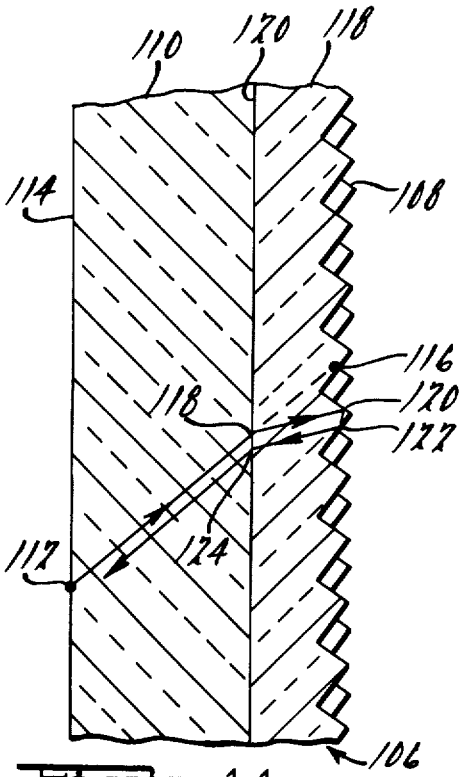
FIG. 11.
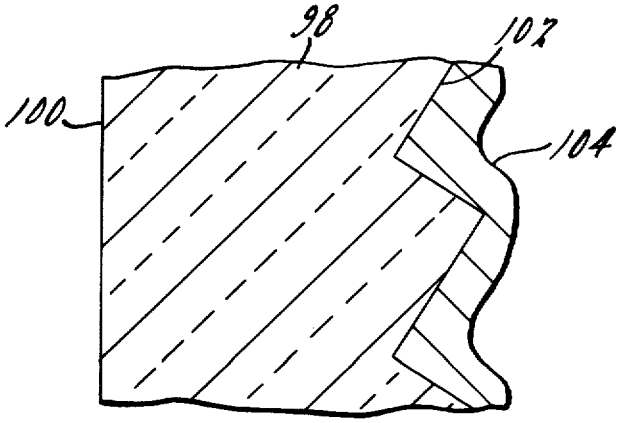
FIG. 13.

IMPACT STRUCTURES

This application is a continuation of application Ser. No. 273,965, filed June 15, 1981, now abandoned.

BACKGROUND AND SUMMARY OF THE INVENTION

The present invention relates generally to objects which may be subjected to forcible collisions, and particularly to structures which are adapted to withstand impacts as well as structures which are adapted to deliver impacts.

Throughout history, collisions of solid objects have been extensively utilized in the development of civilizations. Impact processes are involved in a diversity of historical inventions ranging from hammers and anvils to cannonballs and armor plating. In the field of armor plating, most of the inventive efforts in recent years have been directed to creating lightweight and inexpensive armor plates for military applications. In this respect it has been found that ceramics when employed in a composite armor plate structure are useful in achieving these objectives. Reference may be had to the U.S. Pat. No. 3,509,833, entitled "Hard Faced Ceramic and Plastic Armor", issued to Cook on May 5, 1970, and to the U.S. Pat. No. 3,705,558, entitled "Armor", issued to McDougal et al, for a detailed treatment of the use of ceramics in armor plate structures.

Although ceramics provide a relatively lightweight material from which armor plate structures may be constructed, the principle objective of the armor is, of course, to defeat a specific projectile traveling at a specific speed. The term defeat in this context does not merely means stopping the projectile from penetrating the armor plate structure. Even though the projectile may not penetrate the armor, the armor plate structure may typically fracture in such a way as to cause a spall or fragment to fly off the back of the structure. The destructive consequences of this type of fracture are readily apparent when the armor is used to protect a confined area, as a tank or the like. Accordingly, an understanding of the fracture modes for armor plate structures is important in providing a truly effective armor plate structure, which is also lightweight and inexpensive.

From an investigation of the fracture or failure modes of impact structures, the applicant has developed a three dimensional shock wave theory which is set forth in the detailed description below. This shock wave theory characterizes a basic conceptual mechanism causing fracture, and is believed to account for the seemingly capricious manner in which certain impacted structures fracture. Briefly, shock waves may result from a dual path phenomena involving constructive interference reinforcement loci upon intersection of two sinusoidal phase related sonic velocity wave train components. These resulting shock waves are frequently hyperbolic in nature. The initial sonic velocity waves are derived from the fracture of or plastic deformation within a material. Depending upon the type and structure of the material these sonic velocity waves may produce a family of spatially distinct shock wave reinforcing intersection locus surfaces. This family of surfaces may comprise a surface for each Fourier frequency spectral component of the complex wave form. Phase velocity along each such locus or intersection surface represents a component of shock wave velocity, is always supersonic, changes as the disturbance moves along the locus surface and may differ in both velocity and wavelength from that along adjacent surfaces of the family which may comprise a shock wave. This shock wave theory in combination with well known optical and reflection laws provide the basis for creating a wide variety of superior impact structures from armor plates and kinetic energy projectiles to hammers and forging dies.

Accordingly, it is a principle object of the present invention to provide a novel structure adapted to withstand impacts.

It is a more specific object of the present invention to provide a lightweight and inexpensive armor plate structure capable of defeating projectiles traveling over a predetermined speed range.

It is an additional object of the present invention to provide a structure capable of returning a large portion of the energy delivered to the structure by the collision with a projectile or an object back to the area of collision for causing fractures in the projectile or object.

It is another principle object of the present invention to provide a novel structure adapted to deliver impacts to relatively slow moving or stationary objects.

It is a more specific obejct of the present invention to provide a projectile capable of rapidly delivering its kinetic energy into engagement with an object after its initial contact with the object.

It is another object of the present invention to provide a pair of impact structures adapted to fracture, deform, strike or shape an object in a more efficient manner.

To achieve the foregoing objects, the present invention generally provides an impact resisting structure formed with means for preventing the reinforcing intersection of a sonic wave train with its own reflection within the structure, such that at least one shock wave fracture mode is eliminated. More specifically, the structure is formed with means for suppressing the specular reflection of high frequency energy at one or more surfaces of the structure. This means may comprise irregularities formed in a surface to roughen the surface in a predetermined relationship with the wavelength of the sonic energy. These irregularities operate to modify the reflection of the sonic waves such that the reflection of the sonic waves back into the material is diffuse, thereby significantly reducing the amplitude of the reflected sonic waves in what would otherwise be a specular direction. In contrast to this randomly rough surface, the aboveidentified means may also comprise a systematically rough or retroreflective surface. The retroreflective surface operates to reflect the sonic energy waves on paths generally parallel to the paths in which the sonic energy waves were transmitted through the structure. Additionally, the structure may comprise a plurality of adjacently disposed plates, each having a different predetermined acoustic impedance, such that the sonic energy wave train may be diffused as it propagates through the structure.

The present invention further provides a structure adapted to deliver impacts to a relatively slow moving or stationary object. This structure may comprise a projectile having a jacket and a spline supported therein for providing a high velocity channel through which a sonic energy wave train may propagate. The high velocity channel operates to modify the rate at which the kinetic energy of the projectile is delivered to the object after its initial contact with the object.

Additional advantages and features of the present invention will become apparent from a reading of the detailed description of the preferred embodiments which makes reference to the following set of drawings in which:

BRIEF DESCRIPTION OF THE DRAWINGS

FIG. 6 is a graph illustrating the hyperbolic paths of the shock waves for the second and third fracture modes in the fracture replica of FIG. 3.

FIG. 11 is a fragmentary cross-sectional view of an impact resisting structure according to a fifth embodiment of the present invention.

FIG. 12 is a rear elevation view of a portion of a structure having a retroreflective surface.

FIG. 13 is a fragmentary cross-sectional view of a retroreflective impact resisting structure according to a sixth embodiment of the present invention.

DETAILED DESCRIPTION OF THE EMBODIMENTS

Figure 1:
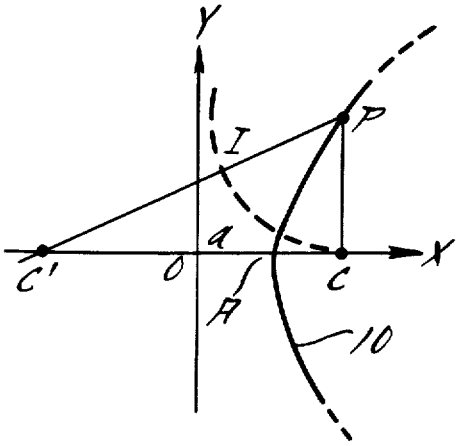
FIG. 1 is a graph of a typical hyperbola which is used in describing the three dimensional shock wave theory forming at least in part a basis for the structures according to the present invention.

Before proceeding to a description of the preferred embodiments according to the present invention, a three dimensional shock wave theory will be described in detail in order to provide a thorough understanding of the present invention. A typical example of an impact fracture in a glass plate will be used to illustrate this shock wave theory.

Shock waves which may be present internally in solids are not well understood. A principle tool is the Hugoniot one dimensional shock wave theory. This theory, while useful in analysis of plane waves in parts of uniform cross section, does not have broad application. The more common spherical wave fronts which result within solid objects from "point" or small area contacts in a collision are not properly subject to Hugoniot analysis.

Apparently overlooked in most past studies of shock waves are the consequences of coherent sonic or acoustic energy wave trains which result upon fracture of an elastic object. When a spring, for example, is stretched until it breaks, it "goes twang". More scientifically, tensile fracture of elastic bodies results in propagation of compression waves from the fracture surfaces which initiate vibratory responses. The stiffer the spring and the lighter the material, the higher the frequency of the vibratory response. In brittle fractures, such frequencies of at least several megahertz are common as will be shown.

In an article contained in the May, 1969 edition of the magazine "Scientific American", entitled "Shock Waves in Solids", a shock wave is defined as "a pulse of pressure or stress that moves through a medium at a speed faster than the medium can transmit sound and produces a steep almost instantaneous rise in stress at the points it reaches." As will be shown herein, shock waves may be generated at the dynamic intersection of elastic wave trains of acoustic energy as this acoustic energy tranverses the elastic medium.

The applicant has found the study of the fracture surfaces of impacted brittle solid objects to be highly revealing of the nature of shock waves. Due to the extremely low ductility of brittle materials, these fracture surfaces may accurately replicate shock wave induced stress. This fracture surfaces are generated as this stress becomes sufficient to cause separation of the intermolecular bonds of the material. Shock wave characteristics which may not reach the fracture stress and which may have occurred beneath the principal brittle fracture surfaces are usually not revealed.

The science of fractography is concerned with the study, taxonomy, analysis and interpretation of fracture surfaces. It is well known in this art that certain emperical relationships exist between certain fracture surface characteristics and certain conditions leading up to and occurring during the fracture process.

The extent of stereotyping of certain fracture surface characteristics is well brought out in a report entitled "Fractography of Ballistically Tested Ceramics", by V. D. Frechette an C. F. Cline, published in the "American Ceramic Society Bulletin" Vol. 49 No. 11 (1970). This report was concerned with a study of impact fractures in brittle plates having a ¼ inch thickness. The plates were variously made of plate glass, hardened steel, sapphire, ruby, alumina, alumina backed by a one inch thick steel plate, and beryillium oxide. The striking projectiles were variously, BB shot, conical pointed steel cylinders, and flat ended steel cylinders. Striking velocities of the projectiles were varied from that required to cause minimal damage to that required to cause complete penetration.

The three factors, plate material, projectile type and striking velocity were permutated. Fractographic examination gave the conclusion that all of the plates sustained damage "by a sequence of events which were qualitatively similar for all materials and for impacts from round-, flat-, and conical-nose projectiles".

No unifying theory has been proposed to explain these qualitative similarities.

Such a unifying theory which will explain some of these similarities follows. This shock wave theory is also capable of partially explaining certain differences between the fractures described and further is useful in making certain quantitative determinations as will be described.

Before proceeding to a description of the preferred embodiments of this invention, this theory will be taught with reference to an example. There will also be included a limited amount of fundamental background material which is well known in several arts but which is not known to have been collected in this context.

The example selected is a classic unsolved problem of perhaps 100 years standing and is known as the Hertzian Cone Fracture. To many, this type of fracture is familiar as a BB shot hole in a plate glass window; on the outside or the impact side, the hole is quite small while on the inside, the hole is approximately ten times larger in diameter; the transition from the small diameter, through the thickness of the glass, to the large diameter is almost—but not quite—conical. In recognition of the not conical shape of the Hertzian Cone Fracture, the more recent literature calls this type of fracture surface a "conoid".

A mathematical model will be developed describing the principal "conoid" fracture surfaces of an exemplary Hertzian Cone Fracture. The model will be graphically compared to the experimental surface on an enlarged scale. The "conoid" surfaces will be shown to be generated by a dual path phenomenon which is hyperbolic in nature. As background, the geometry of a hyperbola which is important to the understanding of this example will now be reviewed.

Referring to FIG. 1, a graph of a typical hyperbola 10, the point 0 indicates the origin of a Cartesian coordinate system. Fixed points C' and C, shown as equi distant from 0, are the foci of the hyperbola. The intersection of the hyperbola with the x axis is its apex, point A. Point P represents a general point on the hyperbola. Thus, lines $\underline{C'P}$ and $\underline{C\ P}$ represent the distances from the foci C' and C to the general point P. The distance from the origin O to the apex A is designated by a.

A hyperbola may be described by the following relationship:

$$\underline{C'P}-\underline{C\ P}=2a$$

or, in English, a hyperbola is the locus of points wherein the difference in the distances from two fixed points, called the foci, is a constant.

Again referring to FIG. 1, note that an arc, shown dashed, of radius $\underline{P\ C}=\underline{P\ I}$ has been drawn with its center at P. This graphically performs the subtraction indicated on the left of the above equation and the difference length $2a=\underline{C'\ I}$. Due to its importance, this difference length will be given a name and hereafter will be called "the phase determinant".

It is an instructive exercise to visualize sliding point $\underline{P}$ up and down the hyperbola varying P I but keeping $\underline{P\ I}=\underline{P\ C}$ and keeping the phase determinant but keeping $\underline{P\ I}=\underline{P\ C}$ and keeping the phase determinant length $\underline{C'I}$ constant. Note that the tangent to the curve at any general point P bisects the angle C'—P—C.

Figure 1A:
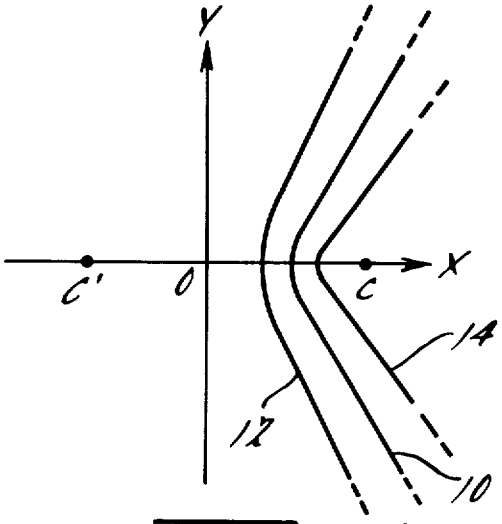
FIG. 1*a* is a graph of a family of hyperbolas including the hyperbola shown in FIG. 1.

Hyperbolas may be said to occur in families. A family type which is relevant to the Hertzian Cone Fracture solution is illustrated in FIG. 1*a*. In this family type, each of the hyperbolas shown has the same fixed foci C' and C and the interfocal distance $\underline{C'C}$ is the same in FIG. 1 and FIG. 1*a*. The phase determinant for hyperbola 10 is the same in FIG. 1 and in FIG. 1*a*, hence hyperbolas 10 are of identical shape.

Hyperbola 12 has been constructed using a smaller phase determinant than hyperbola 10 while hyperbola 14 has a larger phase determinant than hyperbola 10. Additional hyperbolas of this $\underline{C'C}$ family may be constructed by assignment additional values of the phase determinant. Note that, as the apex of a hyperbola is closer to a focus, the apex is more sharply curved. Departing along a hyperbola from the apex, the curvature of a hyperbola becomes straighter and the curve diverges from adjacent hyperbolas of the family.

In FIG. 1*a*, the Y axis is a hyperbola of this family having a phase determinant equal to zero, from point C to the right, the x axis contains a hyperbola of the family whose phase determinant is equal to the inter focal distance.

Shock waves will be shown to result along hyperbolic paths when two phase related acoustic energy wave trains of circular frontal cross section intersect; point sources of these wave trains may be the foci of a family of hyperbolas as will be shown.

Of importance to solution of the Hertzian Cone Fracture is a phenomenon called the Hertz stress. Published in 1896 were Hertz's contact equations for a normally loaded sphere on an elastic half space. These static equations describe a maximum tensile stress locus on the surface of the half space as being a cricle. This circle is the perimeter of the mutual contact area as the sphere indents the half space.

Figure 2:
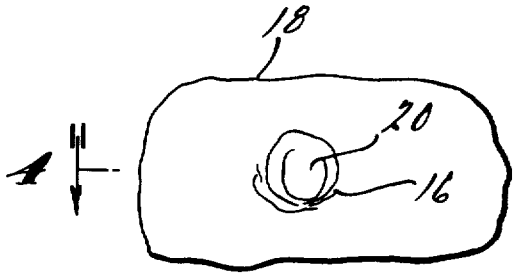
FIG. 2 is a view of a surface of a glass plate which illustrates a plurality of Hertz stress cracks resulting from a collision with a projectile.

FIG. 2 illustrates a circular Hertz stress crack array 16 as may result when a projectile lightly strikes a piece of thick plate glass 18. These partially completed cracks are approximately 0.048" in diameter and roughly 0.010" to 0.015" deep. Note that, in the practical example shown, the crack is not a single precise circle, but instead, is an array of sometimes overlapping arcs. This lack of circular perfection may be due to material defects, rotational "English" of a projectile, or an impact that is at slight variance from the perpendicular.

The Hertz stress crack is the first fracture mode and the direct cause of the second fracture mode involved in the Hertzian Cone Fracture.

Figure 3:
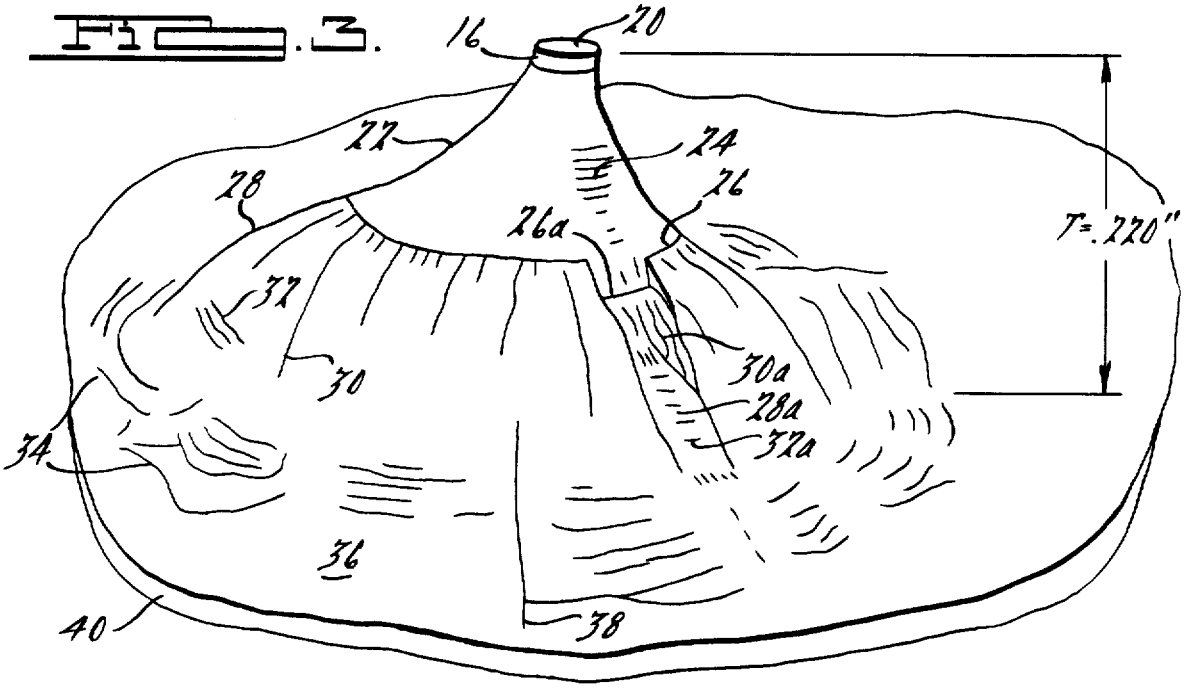
FIG. 3 is an enlarged perspective view of a plastic replica which was cast into the cavity of a Hertzian cone fracture induced in a glass plate by a higher velocity collision than that of FIG. 2.

FIG. 3 is an enlarged perspective view of a plastic replica which was cast into the cavity of a Hertzian Cone Fracture. This fracture was produced in T=0.220" thick plate glass by the impact of a BB shot.

The generally cylindrical Hertz stress fracture mode is shown at 16. Surface 20 represents a remnant of the front surface of the plate.

The slightly concave surface 22 represents the second fracture mode. It is very smooth, slightly concave and carries extremely slight circular markings 24 which are only visible when strongly illuminated. This second fracture mode largely terminates at collar line 26 where the third fracture mode commences.

The surface 28 is slightly convex and represents the third fracture mode. Commencing at collar line 26 the surface is strongly hackled. Some of the hackle lines, as at 30, extend approximately ¾ of the way to the bottom of surface 28. There are light circular markings 32 on surface 28 similar to markings 24.

The fourth and final fracture mode commences at the base of surface 28 where thin shelving conchoidal (so called because of resemblance to a sea shell) fractures 34 extend outward and downward to intersect the rear surface of the plate 36. In this particular fracture there are twelve distinct zones or flakes of conchoidal fracture 34 of varying widths. These flakes are sometimes bounded by radial cracks as at 38.

Edge 40 was formed during casting of the replica by a dam of putty placed on the rear surface 36 of the plate to confine the liquid casting material.

Figure 4:
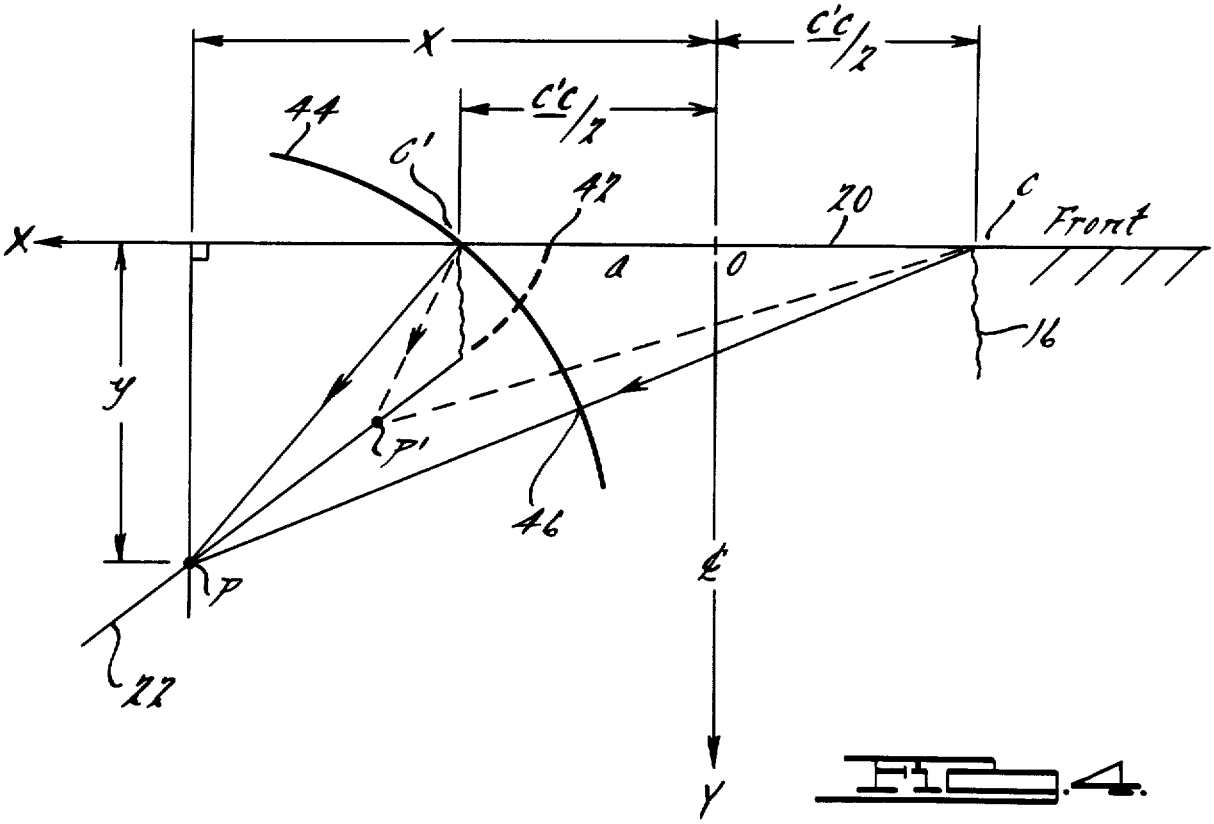
FIG. 4 is an enlarged cross-sectional view of a glass plate of FIG. 2 generally taken along lines 4—4 and particularly illustrating the Hertz stress cracks of the first fracture mode, and a hyperbolic second fracture mode.

FIG. 4 represents a greatly enlarged section view of the Hertz stress crack 16 in the front surface of the glass plate 18. The centerline represents the axis of impact of the BB shot. Vibrating corners of the cylindrical crack C' and C are taken as foci of a family of hyperbolas to be developed which include the second mode fracture surface 22. Hyperbolic surface 22 has been extended into the cylindrical volume surrounded by the crack 16 as a dashed line which intersects front surface 20 at apex point 42.

Let a coordinate system by established with the x axis in front surface 20 and the y axis in the centerline. The origin is at initial impact point O.

Let P be a general point on fracture surface 22 having coordinates x and y. (In this mathematical context, it is a property of a general point that it may be moved about within the coordinate system subject to constraints which are to be defined by equations.) C'C is the interfocal distance.

Draw a ray C'P and a ray C P. These rays represent paths traversed by circular cross section sonic wave fronts from corners C' and C to pont P as these corners vibrate upon their release following formation of the crack 16.

Draw arc 44 from center P through C' to intersect C P at point 46. Now, length 46 C is the constant difference in the distances from the foci C' and C to various points P and this is the condition to make surface 22 hyperbolic. Length 46 C is then the phase determinant and equals two times the distance from apex point 42 to origin O, also marked a.

Acoustic waves generated from foci C' and C are in synchronism with one another because C' and C are but two points on the stressed ring like structure which surrounds the cylindrical crack 16. This ring like structure vibrates as a unit and insures that C' and C act in concert as phase locked coherent sources. Although the expanding acoustic wavefronts originating from C' and C may be thought of as two circles expanding at sonic velocity in the section view of FIG. 4, the actual wavefront in three dimensions is the half surface of an expanding torus.

The importance of phase determinant length 46 C should now be becoming apparent. This importance is that, if phase determinant length 46 C is an integral number of wavelengths of a frequency emitted by phase locked sources C' and C, waves from these two sources will arrive at point P and at all other points along hyperbola 22 in phase such that the tensile and compressive halves of the waves from the two sources reinforce each other by suprposition.

For a different frequency which may be another sonic Fourier component of a complex wave form emitted from C' and C, a different length phase determinant may be selected so as to make its length an integral multiple of the new wavelength. A different hyperbola will result which will be of the same family as before, having the same interfocal distance C'C. Shorter phase determinants will result in steeper hyperbolas 22 while longer phase determinants make a less steep hyperbola 22. Acoustic frequencies as they combine are thus spatially segregated as in a spectrum of shock wave loci.

The shock wave velocity of the sonic ray intersection P as it moves down hyperbola 22 is always supersonic and may be obtained for any point along the hyperbola by dividing the sonic velocity in the material by the cosine of the angle between the tangent line to the hyperbola at that point and either one of the rays.

If we initially select point P to be a rarefraction maximum, as point P is moved down hyperbola 22 at supersonic velocity by the lengthening of rays C'P and C P at sonic velocity, point P remains always a rarefaction throughout its motion down hyperbola 22 and material along the path 22 will be subjected to a maximum tensile stress during the transit.

Following point P in its transit down the hyperbola 22 there is a second point P' which has been selected such that dotted ray C'P' is exactly ½ wavelength shorter than ray C'P. (This also insures that dotted ray CP' is exactly ½ wavelength shorter than ray C P.) As point P was chosen to represent a moving locus of maximum tensile stress along the hyperbola 22, point P' represents a compressive maximum. Thus additional points of alternating tensile and compressive maxima follow one another down the hyperbola. Fixed elements of the material along the hyperbola are thus alternately subjected to these tensile and compressive stresses.

It should be noted that, while P and P'; are 180° out of phase with each other, the distance between them does not equal ½ wavelength of the original Fourier frequency component used to establish hyperbola 22. Instead, the wave length of the shock wave as measured along hyperbola 22 must be shorter than the wave length of its driving sonic Fourier frequency component in order to compensate for the increase in velocity of the shock wave above sonic velocity. Progressing outward along the hyperbola, the shock wave length increases and shock velocity decreases and, as the length of the hyperbola approaches infinity, both wave length and frequency approach sonic values. Amplitudes of the summation disturbances traversing are not believed to be subject to the inverse square law as it might be applied to the lengths of the two rays since the wavefront is toroidal and not spherical.

Let the length of ray C'P=0.216t where 0.216"/u sec. =the sonic velocity and t u sec.=time.

Then the length of ray C P=0.216t+37 C

Each of these rays is the hypotenuse of a right triangle and by the Pythagorean theorem we may write from FIG. 4 to define hyperbola 13:

$$(1)\ y^2+(x-\underline{C'C}/2)^2=(0.216t)^2$$

$$(2)\ y^2+(x+\underline{C'C}/2)^2=(0.216t+\underline{46\ C})$$

Acoustic waves behave, in many respects, in a manner which may be related to optical phenomena. In particular, some phenomena of reflection will be briefly reviewed as background for development of the theory for surface 28.

The technique of folded path ray tracing may be used in optics to explain the well known phenomena that an object, when viewed in a mirror, appears to be as far behind the mirror as it actually is in front of the mirror. This technique also explains the barbershop mirror phenomena wherein multiple regressive reflections may be viewed in a room having mirrored opposite walls.

The barbershop mirror phenomena is important when a point source of acoustic energy within or on the surface of a plate emits sonic energy. This energy may be internally reflected back and forth between the walls of the plate, with the plate thickness being analogous to the width between the mirrored walls of the room.

The acoustic interaction of a source with its own reflection is important because wave trains from a source and from the reflection of that source may bear a constant phase relationship with one another and hence may interact to produce a shock wave as previously described. If the two interacting wave fronts are of circular cross section, the resulting shock wave(s) may be hyperbolic in nature. As will be shown, this is the general scenario for the forming of the third fracture mode surface 28 of FIG. 3.

Figure 5:
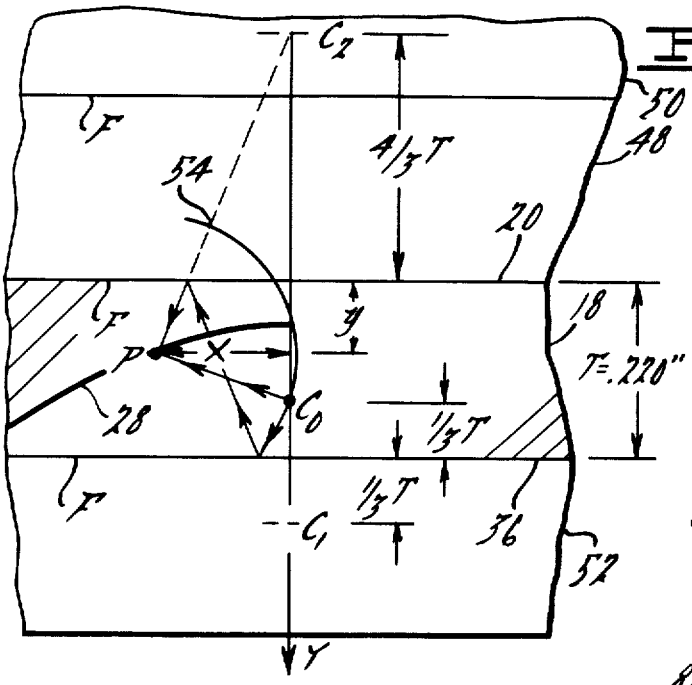
FIG. 5 is a fragmentary cross-sectional view of a plate with mirror images of the plate shown in phantom on each side thereof for illustrating the acoustic interaction of a source with its own reflection.

FIG. 5 illustrates a section view of a plate 18 having thickness T and front surface 20 and rear surface 36. One third of the thickess T from the rear surface of the plate and on the centerline is fixed point $C_o$ which represents a center emitting spherical coherent sonic waves as if $C_o$ were a point source.

Above and below the section view of the plate are folded images 48, 50 and 52 of the plate. The section view and images are hinged together in imaginary fashion on the three fold lines F so that the images may be folded and superimposed upon the section view. $C_1$ and $C_2$ represent respectively the first reflection of $C_0$ from rear plate surface 36 and the first reflection of $C_1$ from front plate surface 20.

Let P be a general point on third fracture mode hyperbola 28 which has foci $C_O$ and $C_2$. On the coordinate system shown, Point P has coordinates x and y. A ray is drawn dashed from $C_2$ toward P. Now, when images 48 and 50 are folded upon the section view, $C_2$ is superimposed upon $C_0$ and the superposition of the dashed line indicates the physical path of the $C_2$ ray to P. This path from $C_0$ to rear surface 36 to front surface 20 then to P has been drawn on the section view with arrows. The direct ray from $C_0$ to P is also shown with arrows.

A single specular reflection may involve a 180° phase lag. If we think of the phase determinant=(N−1)L, where N=an integer and L=the wavelength of the frequency being reinforced at P, we take into account the one wavelength lost in the two reflections.

The phase determinant length may be graphically determined in FIG. 5 by swinging an arc with point P as center and of length $\underline{P\ C_0}$ to intersect ray $\underline{P\ C_2}$ at point 54. The phase determinant is then length $\underline{54\ C_2}$.

As before, we may write for two right triangles:

$$(3)x^2+(2T/3-y)^2=(0.216t)^2$$

$$(4)x^2+(4T/3+y)^2=(0.216t+\underline{54C_2})^2$$

Measurements of the FIG. 3 Hertzian Cone Fracture have been made and substituted into equations (1), (2), (3) and (4), values of t substituted at 0.1 microsecond intervals, the equations solved, results tabulated and plotted on FIG. 6 resulting in a contour which is an excellent fit to the experimental surface.

Substitutions for equations (1) and (2) were: 0.024″=one half the interfocal distance which equals the measured radius of the Hertz stress crack, 0.216″/u sec. sonic velocity, and 0.041″ phase determinant. These points are plotted on FIG. 6 as small squares. They described the second mode fracture surface 22 between the cylindrical Hertz stress crack and collar ring 26. This surface is slightly concave as is the corresponding surface in FIG. 3. This curve has been evaluated and extended down to rear surface 36 of the plate even though it is responsible for the principal fracture surface only down to collar ring 26; this extension running beneath surface 28 is believed to exist during the fracture process as a stress concentration surface as we now interrupt the continuity to explain.

Fortuitously, in this Hertzian Cone Fracture there was apparently a material defect resulting in a small interruption in surface 28. This is shown in FIG. 3 and is instructive as to what stresses once lay beneath likely the entire surface 28. Echeloned beneath the small arcuate interruption in collar ring 26 is revealed a small but distinct portion of a second collar ring **26*a* with its own second set of hackle markings 30*a*. Additionally there is a surface 28*a* with light markings 32*a* which is likely another component of the family of surface 28**.

Referring again to FIG. 6, the third fracture mode surface 28 is described by equations (3) and (4). Substitution of the sonic velocity=0.216″/u sec. and only two linear dimensions is sufficient to describe the surface. The two dimensions are, plate thickness T=0.220″ and the phase determinant length=0.254″. These points are plotted as small circles, and again, except for the end points, they are at 0.1 u sec. time intervals.

Note that this hyperbola has been plotted beginning where it commences at infinite velocity on the Y axis although the portion of the curve between the Y axis and point 26 does not appear on the "conoid" surface. The velocity of the disturbance decelerates rapidly until at the point marked by the three small concentric circles it is traveling at Mach 2. Mach 2 may be readily determined as being the point on the hyperbola where the direct ray and the reflected ray from the foci intersect at an angle of 120°. The disturbance then proceeds to the collar ring mode shift point 26 on the "conoid" surface and downward generating third mode fracture surface 28.

It is empirically known in the art of fractography that hackle occurs on a brittle surface at locations where a propagating crack surface encounters a region which is highly stressed. This indicates that surface 22 is still being stressed when intersected by surface 28 producing hackle 30 below collar ring 26.

The fourth concoidal fracture mode is outside the scope of this invention and will not be discussed further.

As in the second fracture mode 22, the velocity of the disturbance along surface 28 is totally supersonic. This is not to say that crack propagation or damage to the intermolecular bonds occurs at supersonic velocity.

The only time information utilized in the equations developed lies in the value assigned to material sonic velocity. The frequencies are believed to be quite high for the components which cause the fracture modes because: First, a sinusoidal disturbance of constant amplitude supersonically imposed on a material will stress the material more the higher its frequency; secondly, the fine circular markings 24 and 32 are extremely short indicating a high information rate was required to shape them; thirdly, the phase determinant for second mode surface 22 for an excellent curve fit was 0.041" and, since this phase determinant must be an integral number of wavelengths, this maximum possible wavelength yields 0.216"/u sec./0.041'=5.27 megahertz; and fourthly, extremely small material defects are known to cause major reductions in the strength of brittle materials and such small defects could likely interact better with short sonic wavelengths.

The basics of this three dimensional shock wave theory seem well supported by the above exemplary analysis. The analysis is however incomplete with respect to tying together the two hyperbolic fracture modes on a single time scale. An important gap here is the lack of a conceptual mechanism for locating $C_0$ in FIG. 5 at a point ⅓ the plate thickness from rear surface 36. $C_0$ was placed at this location for the exemplary fracture because, in conjunction with $C_2$, as foci, an excellent fit with the replicated fracture resulted.

Some of the basics of this three dimensional shock wave theory will now be reviewed:

(1) Shock waves may result from dual path constructive interference of two phase related ultrasonic wave trains.

(2) The ultrasonic wave trains are extremely high frequency.

(3) Where the ultrasonic wave fronts are of circular cross section, the resulting shock waves are hyperbolic.

(4) The supersonic velocity of a shock wave may equal the phase velocity of the intersection of the two wave fronts.

(5) The two wave trains involved may originate from a source and a reflection of that source.

(6) If the source is broad band, each frequency component will produce its own spatially distinct locus of reinforcing interference as one of a family of curves.

(7) Some shock wave fronts may be represented by the end on view of such a family of curves wherein the velocity along each curve may be slightly different, thus a shock wave of this type may be thought of as having a spatial velocity profile.

(8) Current scientific knowledge concerning wave motion may now be taken from fields of optics and acoustics to be better applied to shock wave effects.

Concerning the intersection of a sonic wave with its own reflections in discussion of the preceding example is the assumption that the sonic waves were internally reflected in a specular manner from surfaces as by a mirror such that the angle of incidence of a ray equals the angle of reflection. Since the preceding discussion makes it apparent that one means of controlling certain shock waves may be by manipulating these reflections, some background discussion concerning their nature will be helpful in appreciating some of the preferred embodiments to follow.

An optical surface may reflect in a specular manner only if it is a smooth surface; particularly, surface roughness must be small when compared to the wavelength of light to be reflected. If the surface is rough, the reflection will be diffuse. In a diffuse reflection, only a very small fraction of the energy incident at a point on the surface is reflected such that the angle of incidence very nearly equals the angle of reflection; diffuse reflections are, instead, governed by the well known Lambert's law.

A material's characteristic acoustic impedance R is the product of its density p and its sonic velocity c such that R=pc. At a material interface where the characteristic impedances are equal, the materials may be said to be matched and the interface is totally transparent to sonic energy.

For a glass—air interface there is a very poor match. Where subscript g indicates glass and a indicates air, the fractional amplitude of a normally impinging ray reflected is:

$$A_r = \frac{R_g - R_a}{R_g + R_a}$$

Since $R_g$ is several orders of magnitude larger than $R_a$, the efficiency of reflection is almost 100%. For obliquely impinging rays, the efficiency is somewhat less but still quite good over the angles of interest.

The two reflections involved in the third fracture mode of the Hertzian cone fracture of glass are reasonably efficient provided the surfaces are smooth. It should now be evident that, by altering the surface conditions required for either one or both of these specular reflections, the third mode intersections required to develop this family of shock waves may be eliminated or substantially reduced in intensity.

Figure 7:
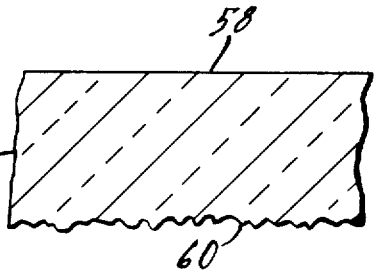
FIG. 7 is a fragmentary cross-sectional view of an impact resisting structure according to a first embodiment of the present invention.

FIG. 7 represents a first preferred embodiment of this invention wherein plate 56 is intended to resist impact of an object striking it upon front surface 58. Rear surface 60 is a rough or irregular surface such as to prevent specular reflections of high frequence sonic energy which may be traversing the material of the plate.

Figure 8:
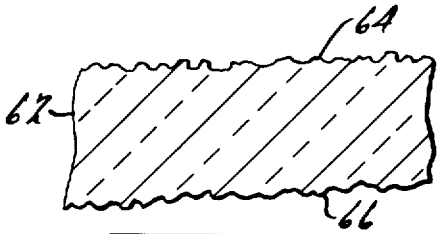
FIG. 8 is a fragmentary cross-sectional view of an impact resisting structure according to a second embodiment of the present invention.

FIG. 8 represents a second preferred embodiment wherein plate 62 has both sides 64 and 66 rough or formed with surface irregularities. As in FIG. 7, the surface roughnesses are such as to produce diffuse internal reflections. This roughness should be small with respect to the plate thickness yet several times the wavelength of the acoustic energy it is intended to diffuse.

Conventional moulded high strength ceramic parts normally have smooth surfaces since this eases the ejection of parts from the mould.

For ceramic plates, this roughness may be incorporated in a mould used to form the plate or alternatively by sintering grains or other small shapes to the surface of the plate. Alternatively, a thin layer of sawdust of wood or other combustible material may be placed on the surface of a mould during forming of a part. This combustible material being subsequently burned out during firing or sintering of the ceramic to leave behind a roughened surface. Further, it may be desirable to make the surface layers porous.

Impacts of projectiles on metallic or ductile armor plates may produce failure modes having distinct similarities to the Hertzian Cone Fracture modes in brittle materials. A principal difference is that all of the shock wave surfaces of a family which produce stresses above the material yield point may produce distortions which precede and contribute to failure.

For example, a HESH (High Explosive Squash Head) projectile may produce failure by impacting at high velocity, a ductile metallic mass against ductile steel armor thus producing a shock wave. This shock wave may be capable of driving a massive spall at high velocity from the rear surface of armor. Even through no perforation of the armor may be produced, such a spall is capable of disabling the interior of an armored vehicle. This spall is generally dome shaped and is analogus to the third fracture mode for the Hertzian Cone Fracture of brittle materials.

In such a ductile fracture, the Hertzian Cone Fracture first and second modes may be replaced by equivalents wherein actual fracture of the brittle material modes are replaced by strained regions which perform substantially the same pre-cursor functions. The strained regions of the first and second ductile modes may emit high frequency sonic energy by the slippage of metallic grain boundaries and crystal slip planes.

Thus the configurations of FIG. 7 and FIG. 8 and some of the others to be described are applicable for improvement of structures made of both ductile and brittle materials. Since specular reflections are necessary for the third failure mode, substitution of surfaces which do not reflect in a specular manner is capable of eliminating this mode of failure.

Figure 9:
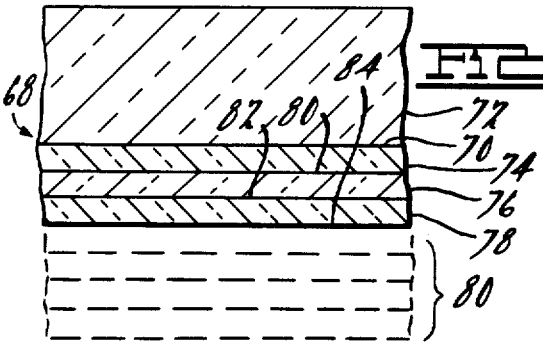
FIG. 9 is a fragmentary cross-sectional view of an impact resisting structure according to a third embodiment of the present invention.

FIG. 9 illustrates a third embodiment 68 of this invention which is also concernred with a means of diffusing internal acoustic reflections from rear surface 70 of plate 72. The materials of additional layers 74, 76 and 78 are in intimate contact with each other and with surface 70 of plate 72. The material of plate 72 has characteristic impedance R72. The materials of additional layers 74, 76 and 78 have characteristic impedances such that R72>R74>R76>R78. Such a plate may be fabricated of ceramic by those skilled in the art by varying the densities of the successive layers. Only a fraction of the amplitude of impinging sonic energy will be reflected from interfaces 70, 80, 82, and 84; thus the resulting reflected rays will be spatially diffused and phase shifted before being returned to plate 72.

By obvious combination, the surface roughening of FIG. 7 or FIG. 8 may be used advantageously in combination with the embodiment of FIG. 9.

A second embodiment for fabricating the structure of FIG. 9 involves implementing plate 72 as a homogenous plate of, say boron carbide ceramic and layers 74, 76 and 78 comprising a fiberglass laminate which may partly serve the function of a backup plate.

Conventional fiberglass laminates as compared to boron carbide ceramic have a much lower characteristic impedance. Therefore there is a poor match of characteristic material impedance so that a large fraction of the sonic energy which impinges on the interface 70 is reflected back into plate 72.

In this embodiment, layer 74 is comprised of woven fiberglass cloth and particles of boron carbide ceramic in a matrix of polyester resin. It is a function of the boron carbide particles to increase the sonic velocity in this layer and to improve the impedance match with the material of plate 72. This improvement is meant in the sense that it is better than that which would prevail were this a conventional layer of fiberglass polyester laminate as is presently used.

The boron carbide aggregate particles should have rounded or smooth corners so as not to cut the threads of the glass cloth and preferably should have the shape of microspheres. The particles size distribution for laeyr 74 should be a maximum packing density distribution with the maximum particles size sufficiently small to pass through the interstices of the cloth. It should be an objective of this construction to bring these particles into abutting contact with one another and with surfaces 27 and 53.

The polyester resin and the particles may be mixed together to form a thick paste which is then knifed into both sides of the cloth to a thickness slightly exceeding the thickness of the cloth, excess resin-from the paste then wicks into the cloth and the resulting surface tension tends to bring the aggregate particles into the desired abutting contact with each other. The resin is then partially cured to form a pre-impregnated sheet by methods well known in the laminated plastics art where it is known as "prepreg".

Additional layers 76 and 78 are prepared in similar fashion except that the aggregate content is successively reduced to meet the criterion that impedances R72>R74>R76>R78. The reductions in aggregate content are preferably taken from the fines end of the particle size distribution leaving the larger sizes to maintain roughly the same volume of aggregate.

The prepreg layers, with additional optional layers 80 to be described may then be assembled to plate 72 and completely cured under heat and pressure.

Some of the embodiments of this invention have utility as components of composite armor and may not have utility as armor by themselves. In the fiberglass embodiment of FIG. 9 however, there is an additional combination of advantages in providing for a more complete armor configuration. Not only does the aggregate addition in layers 74, 76 and 78 improve the impedance match with plate 72, but the aggregate addition increases the compressive strength of these layers. With the addition of conventional optional layers of fiberglass 80 a stiffer and stronger backup structure for plate 72 results with very little increase in weight.

Figure 10:
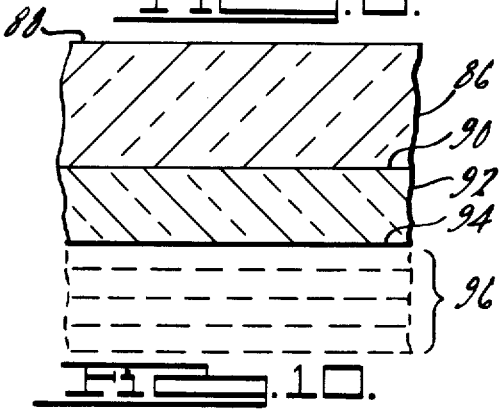
FIG. 10 is a fragmentary cross-sectional view of an impact resisting structure according to a fourth embodiment of the present invention.

Now turning to the embodiment of FIG. 10, 86 represents a plate or the body having a generally homogenous characteristic material impedance which it is desired to protect from failure by shock wave induced stresses such as may result from impact on a front surface 88. Intimately in contact with body 86 over its rear surface 90 is supplementary layer 92 between surfaces 90 and 94. Layer 92 has a smooth gradation of values of characteristic impedance from a highest value at interface surface 90, which preferably matches the impedance of body 86, to a lowest value at surface 94.

The function of the FIG. 10 embodiment is similar to that of FIG. 9 in that both may diffuse energy in depth, i.e. spatially and in time. The diffusion process in layer 92 is more spatially continuous in contrast to the stepwise diffusion of layers 74, 76 and 78.

Similarly, a diffusing layer similar to 92 may also be placed on front surface 88. Such a front layer may further be of advantage in changing or damping the Hertz stress crack and damping or dispersing the vibratory sonic energy which results from the first fracture mode.

Layer 92 is preferably fabricated of the same material as object 86 with the gradation of impedance accomplished by varying the density or porosity of the material between surfaces 90 and 94. Optionally, layers 96 of conventional fiberglass laminate may be added behind surface 94.

Where body 86 is ceramic armor plate, the weakness of the rear portions of layer 92 may be of advantage during the later phases of an impact which approaches penetration. The weaker rear portions will tend to crumble into small particles and envelope sharp jagged pieces into which the stronger material of plate 86 may be expected to fracture. This enveloping action will tend to reduce likelihood of cutting or localized stress concentration on a backup layer such as 96. Thus an enveloping layer of finer size particles may be beneficial when placed behind a hard brittle armor facing.

In addition to the diffusion means described above, there are further means whereby very high frequency sonic waves may be manipulated by changing the manner in which wave compoennts are reflected so as to be useful in modifying shock waves.

In the arts of both optics and microwaves, the properties of a symmetrical array of cubic projections formed in a surface or corner reflectors are well known. These result in an impinging ray being reflected back toward the source on a path parallel to the original ray. It is also known in these arts that, in order to be effective, such a cubic projection array or corner reflector must generally be of dimensions which are several times the wavelength of the radiation to be handled.

Acoustic waves are customarily thought of as being longer than would permit utilization of corner reflectors of practical size. Further, until this disclosure, the importance of the very high frequency wave trains which may be produced in solids by non-elastic strain and by fracture and the means whereby these very high frequencies may combine to form shock waves have not been appreciated. We may now utilize retroreflective means generally adapted from other arts to control shock waves. Two commonly used optical retroreflective means are known as "Stimsonite" and "Scotch Lite®" (a trademark of 3M), the first being a corner reflector array and the second operating by spherical refraction.

FIG. 12 illustrates a corner reflector array geometry as may be formed into the surface of a plate or other part 98 to modify the manner of formation of shock waves therein or in an adjacent object with which part 98 may be in intimate contact. FIG. 13 is a fragmentary section view of FIG. 12 as indicated by arrows 13—13. 100 is the front surface of the part or plate while 102 indicates the rear retroreflective surface. Since this geometry is well known in the optics art, it will not be described further here.

For example, a point source of sonic energy located on front surface 100 may radiate on a spherical wave front into a plate 98. Upon being reflected from rear surface 102, the wave front is no longer of circular cross section, hence, the significant intersections of the reflected wave with the wave being emitted from the front surface are not hyperbolic in nature. The shock waves will lie generally parallel to the surface of the plate, they do not intersect the rear surface of the plate and for only certain long wavelengths do they intersect the front surface.

The divergence of the rays emitted on a spherical wave front from an initial source on front 100 of the plate subjects these rays to reduction in amplitude by the inverse square law. Upon being retroreflected from surface 102, these rays are reconverged. The net result being that, depending on the efficiency of transmission and reflection, energy delivered into the plate is returned to the immediate vicinity of the original source on front surface 100.

Thus, if the original source is energized by a military kinetic energy projectile striking the plate, energy generated in the impact will be returned by retroreflection to the mutual contact area. This should result in significantly greater damage to the projectile than if the rear surface of the plate were not retroreflective.

In armor, the configuration of FIGS. 12 and 13 may be formed as plates as is presently common practice or alternatively, it may be assembled as a mosaic of hexagonal pieces, each piece carrying a corner reflector on one end of what is otherwise a right hexagonal prism.

As is well known in optical applications, prisms, corner reflectors and corner reflector arrays such as stimsonite are dependent on the phenomenon of total reflection. When a wave is propagating in a first medium and encounters an interface with a second medium and the second medium has a faster propagation velocity than the first, there is a critical angle of incidence for the wave upon the interface. When this critical angle of incidence is exceeded, the wave is totally reflected from the interface.

The greater the difference in propagation velocities, the smaller is the critical angle of incidence.

For example, for an interface between steel (0.197"/u sec.) and alumina (0.456"/u sec.) the critical angle is:

$$\mathrm{Sin}^{-1}\frac{.197}{.456} = \mathrm{Sin}^{-1}.432 = 25.59^{\circ}$$

In FIG. 13, for example, we may make plate 98 of steel and in order to obtain an appropriate critical angle, plasma spray a dense tightly adhering conformal coating of alumina 104 onto stimsonite surface 102. Alternatively, conformal coating 104 may be of porcelain enamel compounded for an impedance match with the steel and having a maximum sonic velocity. Further, alternatively, the function of 104 in providing a high sonic velocity interface to provide total sonic reflection may be accomplished by making 104 a plate of alumina bearing stimsonite surface 102 against which may be formed a slower sonic velocity metal plate 98 as by vacuum casting.

Total reflection is not essential to the functioning of a stimsonite array as a retroreflector of sonic waves since reflection from the elemental surfaces of the array may be accomplished with some efficiency by a simple impedance mis-match at the surfaces. Such impedance mismatch reflection, however, makes the structure subject to failure by the well known Hopkinson fracture phenomenon if the energy of the sonic wave is extremely large.

The embodiment 106 of FIG. 11 utilizes refraction to reduce the obliquity of rays of sonic energy impinging on a retroreflective array 108 originating from a source in or on plate 110, for example, at point 112 on front surface 114. This reduction in obliquity increases the solid angle of rays from point 112 which may be retroreflected.

For example, the path from 112 to 116 may be sufficiently oblique not to be retroreflected. If the sonic velocity in plate 118 is less than the sonic velocity in plate 110, the ray from 112 to 118 will be refracted at interface 120 according to Snell's law thus striking array 108 less obliquely and being retroreflected at 120 and 122 and again refracted at 124 to be returned close to the point of origin 112.

For efficient transmission of sonic energy across interface 120, the characteristic material impedances of the materials of plates 110 and 118 should be closely matched. For example, plate 110 may be of alumina and plate 118 of steel.

Where the structure of FIG. 11 is utilized as an armor component, it may be desirable to add an additional cover plate similar to back up plate 118 to surface 114 of plate 110.

In the amplitudes of sonic waves encountered in armor, there is a high stress concentration locus which may occur when a tensile maximum of a retroreflected wave meets and reinforces by superposition a tensile maximum of the incoming wave train. For a corner reflector having dimensions on the order of several wavelengths, such reinforcements may occur within the corner. If the amplitudes are sufficiently high and fracture occurs, a pyramidal piece will be truncated from the corner and may leave in a direction perpendicular to the fracture plane at high velocity. Such fractured pyramids are sufficiently small to be readily captured by an additional layer and they serve to carry away energy early on in the impact process without significantly reducing the armor thickness. When it is an armor objective to retroreflect as much energy as possible from a corner reflector, for example to break up a brittle kinetic energy projectile, the corners should be made of a maximum tensile strength material. When it is an armor objective to absorb high amplitude sonic velocity energy in the corners, the material of the corners should be more ductile to maximumize the work involved to elongate and to fracture off the pyramidal pieces.

Such retroreflecting means are of utility in both ductile and brittle parts for modifying of shock waves therein. Such means may be of utility in objects which either deliver or receive impact.

Figure 17:
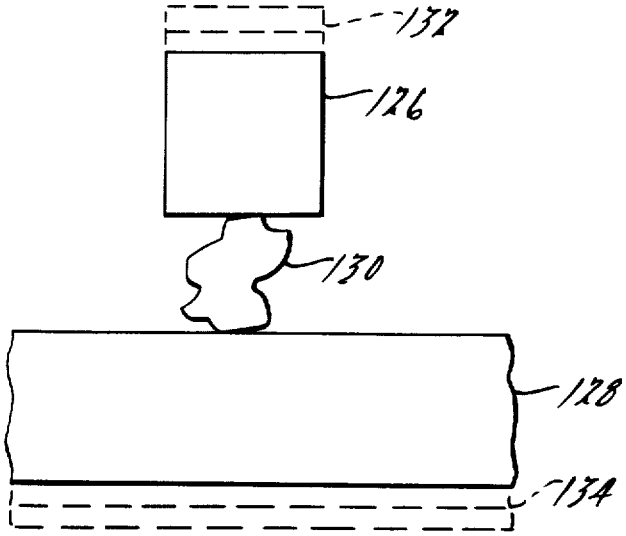
FIG. 17 is a fragmentary cross-sectional view of a pair of structures in accordance with the present invention which are adapted to crush as object interposed therebetween.

In FIG. 17, 126 represents a hammer or other object suitable for delivering an impact, alternatively, a rock crushing roller, a punch, a drop hammer, etc. 128 represents an anvil or other structure suitable for backing up an impact, alternatively, a second rock crushing roller, a die, a forging die, etc. 130 represents an object to be crushed or subjected to non elastic deformation wherein high frequency sonic energy is generated when said object is crushed or non elastically deformed.

Retroreflective surfaces represented generally by 132 and 134 may be stimsonite with a conformal high sonic velocity coating as in FIG. 13 or any other suitable retroreflective means. It is the objective of the retroreflective surfaces to reflect back into object 130 high frequency sonic energy resulting from initial crushing or non elastic deformation in order to further the subsequent crushing or non elastic deformation of object 130.

The manner in which hardened bullet cores are broken up appears to lack basic conceptual mechanisms. Some interactions between ceramic armor and a hardened small arms bullet core will now be discussed.

Figure 14:
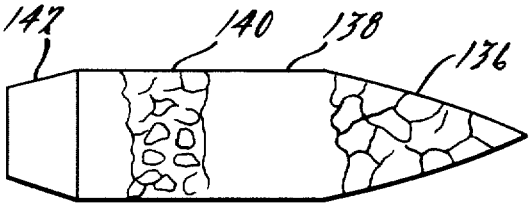
FIG. 14 is a side elevation view of a fragmented projectile which has been reassembled for illustrative purposes.

FIG. 14 illustrates fragments of a hardened bullet core, re-assembled following impact with ceramic plate. Such fractures are well known, having been published in the literature. There is a zone of tip fragments 136, an intact midsection portion 138, a zone of midsection fragmentation 140, and an intact tail portion 142. Applicant believes two different mechanisms or processes are responsible for the two fragmentation zones 136 and 142.

Tip fragmentation 136 is believed caused by a mechanism of intermittent support. Upon contacting the armor, the tip of the core is highly compressed, the armor fractures at near its sonic velocity rapidly removing the support, the compressed portion of the core is then accelerated forward until inertially induced tensile failure occurs. The ogive of the core then proceeds into the armor until it again encounters support and the process is repeated. When this intermittent support is no longer provided, this type of failure stops.

The zone of midsection fragmentation 140 is believed caused by the intersection of two sonic waves which are initiated as compressive waves during the early contact of the core tip and the ceramic. A first acoustic wave front enters the ceramic plate from which it re-enters the core, having been reflected from the rear plate surface as a tensile front. A second wavefront travels uprange to the base of the bullet core from which it too is reflected as a tensile front. These two waves intersect at extremely high velocity at the zone of mid section fragmentation.

Because both these waves must traverse that protion of the core length between the tip and zone 140, the time for the first wave to make its dual path transit through the ceramic plate is equal to the dual path transit time for the second wave from zone 140 to the bullet base. In other words, the "sonic length", i.e. the physical distance divided by the sonic velocity, of the ceramic plate thickness is equal to the sonic length from zone 140 to the bullet base.

This illustrates an advantage of the high sonic velocity of the ceramic armor in bringing this shock wave intersection into the bullet. The bullet would suffer lesser damage if it were sonically shorter than the ceramic plate sonic thickness as this would place this shock wave in the armor rather than in the bullet.

Aside from this particular fracture mode, there is another very significant advantage to a sonically short projectile in that it is capable of faster engagement of its mass with the target.

The advantage of higher striking velocity of a kinetic energy projectile in penetrating armor lies not only in the greater quantity of energy it can deliver, but also in the rate at which it delivers energy into the armor.

Thus, if a projectile is six inches long and made of steel (sonic velocity 0.197"/u sec.) it requires $6/0.197=30.5$ microseconds following initial contact of the projectile with the armor before the energy at the base of the projectile may commence to be delivered to the armor. If the armor is a large alumina plate (sonic velocity 0.456"/u sec.), in that length of time, armor material to a radius of $30.5\times0.456=13.9$ inches from the point of impact will have become involved to at least some extent in draining energy from and in defeating the projectile.

Figure 15:
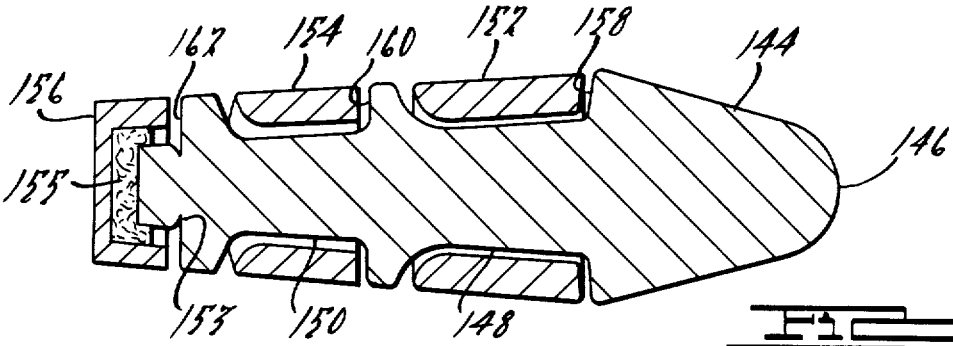
FIG. 15 is a cross-sectional view of a composite projectile according to the present invention.

FIG. 15 is a section view of a composite, sonically short, kinetic energy penetrator component intended to defeat armor by being able to bring its energy more quickly into engagement following initial contact with the armor. Such a penetrator component may be accelerated and delivered against a target by conventional delivery means, which would generally include a suitable casing serving to package the penetrator for delivery.

Spline 144 is coaxial with the anticipated path of travel of the projectile. Nose 146 is radiused. 148 and 150 are spool like depressions having a slight conical taper and this same line of taper continues forming the outer surface of the reat stub of the spline. Spline 144 is made of a material of high sonic velocity and strength and is preferably of ceramic. The axial alignment of spline 144 serves to act as a fast channel or conduit for rapidly decelerating mass components 152, 154 and 156. Mass components are preferably of high density and a good characteristic material impedance match with the material of spline 144. Typical metals available for the mass components have slower sonic velocities than the spline material. The decelerating forces are thus brought quickly and in a simultaneous fashion, to be described, to tip 146 to effect penetration of the target.

Annular abutment surfaces of spline 144 are numbered 158, 160 and 162. These surfaces are generally perpendicular to the axis of spline 144 and there are abutting mating surfaces (illustrated with a small separation for clarity) on the mass components 152, 154 and 156 such that the mass components may exert axial force on the spline 144 in the direction of nose 146 through these surfaces.

Note that the mass components 152, 154 and 156 are axially successively shorter. This arrangement is in accordance with the sonic velocities in the spline material and in the mass components and with the geometry of the sonic paths in the penetrator. It is a design criterion for this penetrator that a sonic wave of compression, as may arise at tip 146 as a result of contact with a target, shall require substantially the same time to travel from tip 146 to the most remote portion of each of the mass components. Thus the sonic distance, i.e. the time required for transit of a sonic wave, from tip 146 through abutment surface 158 to the rear of component 152 equals the sonic distance from tip 146 through abutment surface 160 to the rear of component 154 equals the sonic distance from tip 146 through abutment surface 162 to the rear of component 156.

Thus it is evident that the penetrator of FIG. 15 is not only sonically short because of the high sonic velocity used in the spline 144, but it is also sonically simultaneous in the sense that the maximum involvement of the mass components in their contributions of deceleration forces arrive simultaneously at tip 146.

During time intervals wherein portions of a projectile are being traversed from front to rear by a compression pulse resulting from contact with a target, kinetic energy is being delivered forward producing forces tending to defeat the target. When such a compression pulse reaches the rear of the projectile, it is reflected as a tensile pulse which then moves forward in the projectile. During the forward transit of such a tensile pulse in a projectile, the portions of the projectile rearward of the pulse are pulling (by virtue of the inertia of said rearward portions) to the rear upon the portions of the projectile that are forward of the tensile pulse.

This rearward tension or pulling which may act on the forward portions of the projectile momentarily tends to decelerate or act as a drag on the forward portions producing impulse which slows the forward portions making them less capable of penetrating the target. There is an opportunity which arises shortly following reflection of a compression pulse from the rear of the projectile and when the resulting tensile pulse has traveled only a short distance forward in the projectile. This opportunity is to discard the short portion of the projectile behind the tensile pulse by permitting the tensile pulse to fracture the projectile; thus, a short portion of the rear of the projectile flies off at high velocity to the rear.

There are several ways of viewing the consequences of such a fracture: First, as is well known, following a tensile fracture, a compression pulse is propagated into both fracture surfaces; the compression pulse which propagates forward adds forward momentum to the portion of the projectile remaining in contact with the target. Second, as a rocket receives forward impulse by discharging some of its mass to the rear at high velocity, so the forward projectile portion receives forward impulse when the rearward portion is ejected to the rear. Third, the fracture relieves the projectile of some of the rearward impulse which it has received from the target up to the time of fracture. Fourth, such a fracture may be looked on as a classic Hopkinson fracture. Fifth, such a fracture provides a means for converting an undesired tensile pulse into advantageous compression pulse.

To accomplish this result, in FIG. 15, mass component 156 is strongly attached by adhesive 155 or by other suitable means to the rear stub of spline 146. Sharp circular groove 153 provides for the fracture location. Groove depth, which determines the tensile cross section area is best determined by experiment. There is no adhesive on abutment surface 162. It is important that the fracture be brittle so as to be accomplished in a minimum of time and with a minimum expenditure of energy.

Figure 16:
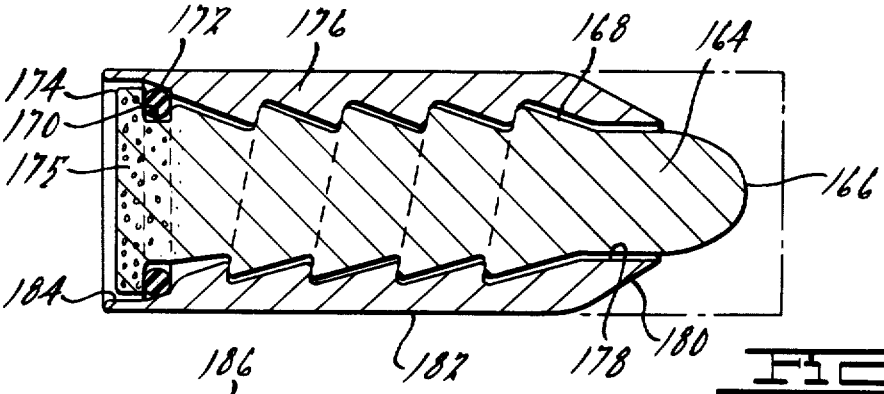
FIG. 16 is a cross-sectional view of another composite projectile according to the present invention.

FIG. 16 illustrates another penetrator component having an axially disposed element of high sonic velocity to enable it to bring its kinetic energy more quickly into engagement with a target.

Ceramic spline 164 is preferably of a material having high sonic velocity, such as polycrystaline aluminum oxide. Spline 164 has a tip 166, a buttress thread 168, a groove 170 for containing a soft elastomeric gasket as "O" ring 172, and a thin flange portion 174.

175 indicates an optional porus region at the rear of spline 164 which is otherwise fabricated to a maximum of strength and density. It is the function of this porus region to diffuse the reflection of the compression wave which traverses spline 164 following contact of tip 166 with a target and thus to reduce the likelihood of fracture similar to zone 140 of FIG. 14.

Mass component 176 is of a higher density material which is preferably a good impedance match with the spline material, say steel, as it is a fairly good match to alumina.

Component 176 has a cylindrical recess 178 which closely fits a mating cylindrical portion of the spline insuring concentricity of the forward portion of the assembly and a buttress thread having a good fit to spline 164 on its vertical portions with minimum lead error but a looser fit on its sloping surfaces. Component 176 also has a sloped wedging portion 180 blended to meet outer cylindrical surface 182 and counterbore 184 which receives and fits to insure concentricity the flange 174 of spline 164.

An elastomeric adhesive may be placed on the buttress thread during assembly of spline 164 into mass component 176. During assembly the thread should be tigthened, compressing gasket 172 sufficiently that adhesive will be squeezed out of vertical portions of the thread and sufficiently that these vertical portions of the thread remain in contact during any setbacks incident to firing.

Note that pick-up or engagement of the mass of mass component 176 by spline 164 commences, after impact of tip 166 with a target, at a time equal to the time required for a sonic velocity compression to travel from tip 166 to the start of buttress thread 168. Thereafter, additional mass of mass component 176 is engaged as the sonic velocity compression progresses up-range from the start of buttress thread 168. This additional mass is picked-up at supersonic velocity as the sonic velocity wave, traveling up-range in spline 164, intersects the helix of the vertical thread face.

It should be recognized that the structures of FIG. 15 and FIG. 16, while described above as penetrator components for projectiles, may be adapted by obvious means to other tools and implements where it is desired to deliver a fast impact. For example, the structure of FIG. 16 may be adapted to function as a hammer head by extending mass component to cover tip 166 as shown in phantom outline.

Figure 18:
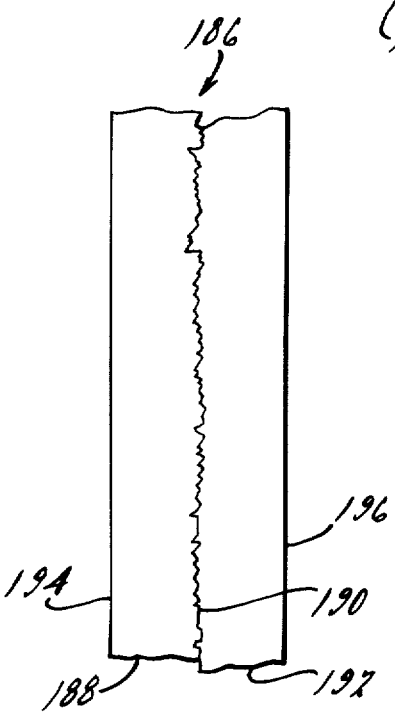
FIG. 18 is a cross-sectional view of a transparent embodiment of the present invention.

FIG. 18 illustrates a plate embodiment 186 for transparent articles which may be required to resist impact penetration such as windshields or windows. Plate 188 may be made of glass or other strong transparent ceramic. The front surface 194 is optically flat so as to permit transmission of optical images of acceptable quality. The rear surface 190 of plate 188 is rough so that it may produce diffuse reflections for the same purpose as described for the embodiment of FIG. 7.

Formed intimately against rough surface 190 of plate 188, as by moulding or casting, is a transparent layer 192 having flat rear surface 196. The material of layer 192, which is preferably a tough plastic material, is constructed such that its optical index of refraction is the same as that of plate 188, thus rendering rough surface 190 invisible and permitting acceptable transmission of optical images completely through plate 186.

As all plastic materials have much lower sonic velocities than glass or ceramics, surface 190, although optically transparent because of matching of the optical indices of refraction, will be acoustically rough because of the mis-match in acoustic impedances. Thus, acoustic energy traversing within plate 188 may be diffusely reflected from surface 190 while optical energy may pass through un-impeded.

It will be appreciated that the above disclosed embodiment is well calculated to achieve the aforementioned objects of the present invention. In addition, it is evident that those skilled in the art, once given the benefit of the foregoing disclosure, may now make modifications of the specific embodiments described herein without departing from the spirit of the present invention. Such modifications are to be considered within the scope of the present invention which is limited solely by the scope and spirit of the appended claims.

What is claimed is:

1. A structure for resisting the impact of a forcible collision with an object, comprising:

a body capable of transmitting a coherent sonic energy wave train through said body created in response to said collision between said body and said object, and having a first surface engageable with said object and a second surface generally opposing said first surface; and means for suppressing the reinforcing intersection of said sonic velocity wave train with its own reflection within said body by diffusing internal acoustic reflections of said sonic velocity wave train at said second interface of said body and suppressing specular reflection of said sonic energy wave train at said second interface of said body, said means comprising random irregularities formed at said second surface of said body and sized in a predetermined relationship with the wavelength of said sonic energy such that said irregularities are several times the wavelength of said sonic energy.

2. The structure according to claim 1, wherein said irregularities eliminates at least one form of shock waves within said body.

3. The structure according to claim 2, wherein said body is a plate with said first and second surfaces being generally planar, and said first surface being generally planar, and said first surface being formed generally parallel to said second surface.

4. The structure according to claim 3, wherein said irregularities are characterized as a roughness for said second surface of said plate.

5. The structure according to claim 4, wherein said plate is constructed from a ceramic material.

6. The structure according to claim 5, wherein said irregularities are formed during the sintering of said ceramic plate.

7. The structure according to claim 5, wherein said ceramic plate provides an armor plate structure for defeating projectiles traveling over a predetermined speed range.

* * * * *

UNITED STATES PATENT AND TRADEMARK OFFICE

CERTIFICATE OF CORRECTION

PATENT NO. : 4,704,943

DATED : November 10, 1987

INVENTOR(S) : JOHN A. McDOUGAL

It is certified that error appears in the above-identified patent and that said Letters Patent is hereby corrected as shown below:

Column 1, line 35, delete "means" and substitute therefor --mean--

Column 2, line 25, delete "obejct" and substitute therefor --object--

Column 3, line 65, delete "as" and substitute therefor --an--

Column 4, line 41, delete "tranverses" and substitute therefor --traverses--

Column 4, line 47, delete "This" and substitute therefor --The--

Column 6, line 3, delete "P" and substitute therefor --P--

Column 6, line 4, delete "PI" and substitute therefor --PI--

Column 6, line 4, delete "P" and substitute therefor --P--

Column 6, lines 4-5, delete "P I - PC and keeping the phase determinant but keeping"

Column 6, line 21, delete "assignment" and substitute therefor --assigning--

Column 6, line 42, delete "cricle" and substitute therefor --circle--

UNITED STATES PATENT AND TRADEMARK OFFICE

CERTIFICATE OF CORRECTION

PATENT NO. : 4,704,943

DATED : November 10, 1987

INVENTOR(S) : JOHN A. McDOUGAL

It is certified that error appears in the above-identified patent and that said Letters Patent is hereby corrected as shown below:

Column 7, line 37, delete "C'C" and substitute therefor --C'C--

Column 7, line 41, delete "pont" and substitute therefor --point--

Column 8, line 2, delete "suprposition" and substitute therefor --superposition--

Column 8, line 66, delete "46C)" and substitute therefor --$46C)^2$--

Column 12, line 67, delete "through" and substitute therefor --though--

Column 13, line 21, delete "concernred" and substitute therefor --concerned--

Column 13, line 62, delete "laeyr" and substitute therefor --layer--

Column 15, line 6, delete "compoennts" and substitute therefor --components--

UNITED STATES PATENT AND TRADEMARK OFFICE

CERTIFICATE OF CORRECTION

PATENT NO. : 4,704,943

DATED : November 10, 1987

INVENTOR(S) : JOHN A. McDOUGAL

It is certified that error appears in the above-identified patent and that said Letters Patent is hereby corrected as shown below:

Column 18, line 12, delete "protion" and substitute therefor --portion--

Column 20, line 51, delete "tigthened" and substitute therefor --tightened--

Signed and Sealed this

Fifth Day of July, 1988

*Attest:*

*Attesting Officer*

DONALD J. QUIGG

*Commissioner of Patents and Trademarks*